US006712290B2

(12) United States Patent
Chien

(10) Patent No.: US 6,712,290 B2
(45) Date of Patent: Mar. 30, 2004

(54) SKIN CLEANER

(75) Inventor: Ghen-Jung Chien, Kaohsiung (TW)

(73) Assignee: Yen Sun Technology Corp. (TW)

( * ) Notice: Subject to any disclaimer, the term of this patent is extended or adjusted under 35 U.S.C. 154(b) by 0 days.

(21) Appl. No.: 10/196,425

(22) Filed: Jul. 17, 2002

(65) Prior Publication Data

US 2004/0025243 A1 Feb. 12, 2004

(51) Int. Cl.[7] ..... B05B 1/24
(52) U.S. Cl. ..... 239/135; 239/136; 128/256
(58) Field of Search ..... 239/135, 136, 239/71, 73, 74, 119; 219/271, 222; 128/368, 256

(56) References Cited

U.S. PATENT DOCUMENTS 3,152,240 A * 10/1964 Scott ..... 392/403
3,351,737 A * 11/1967 Katzman et al. ..... 392/337
3,495,343 A * 2/1970 Duncanson ..... 34/72
3,511,236 A * 5/1970 Conlin et al. ..... 128/203.27
3,707,971 A * 1/1973 Yamamoto ..... 607/84
3,768,483 A * 10/1973 Kusunoki ..... 607/84
3,949,743 A * 4/1976 Shanbrom ..... 128/200.14
4,300,556 A * 11/1981 Ochi et al. ..... 604/291
4,314,138 A * 2/1982 Itoh ..... 392/403
4,616,122 A * 10/1986 Burian et al. ..... 392/403
4,621,641 A * 11/1986 Frank et al. ..... 607/84
5,423,485 A * 6/1995 Tagusari ..... 239/121
5,805,767 A * 9/1998 Jouas et al. ..... 392/373

* cited by examiner

*Primary Examiner*—Gregory L. Huson
*Assistant Examiner*—Azy Kokabi
(74) *Attorney, Agent, or Firm*—Bacon & Thomas, PLLC

(57) ABSTRACT

A skin cleaner includes a lower container, and an upper bowl having a rim defining an opening for receiving the face of users. The container has a chamber for containing a first liquid while the bowl has a cup located in the opening for containing a second liquid. A heater is provided for heating and converting the second liquid into vapor, which is then discharged from the cup into the opening of the bowl. The skin cleaner further includes a nozzle disposed in the bowl, and a pump for pumping the first liquid to the nozzle and spurting the first liquid from the nozzle over the face received in the bowl.

18 Claims, 6 Drawing Sheets

SKIN CLEANER

BACKGROUND OF THE INVENTION

1. Field of the Invention

The present invention relates to a skin cleaner and, more particularly, to a skin cleaner of a domestic type which massages as well as cleans the face of users.

2. Description of Related Art

There are many devices for improving the skin of a face. For example, a face massager is disclosed in Taiwan Pat. Publication No. 375,931 which, as shown in FIG. 6, includes a casing 90 for receiving a reciprocator 93 and a driving unit 94. When the driving unit 94 is actuated, the reciprocator 93 is moved to and fro to repeatedly push a pad 92 out of a mouth 91 and to press the pad 92 against the face of users.

Although the face massager can repeatedly press the users' face, it can not clear greasy debris off pores in the skin. On the other hand, the skin may become rougher by inevitable rubbing of the pad 92 over the face.

A face steamer is disclosed in Taiwan Pat. Publication No. 223,239 which, as shown in FIG. 7, includes an upper cover 81, a lower container 82 and an adjacent upright duct 83, with an opening defined in the upper cover 81. In the lower container 82, there is provided a fan, a heater, a vibrator and an ultrasonic oscillator, all being used for producing a steam which is then discharged from the upright duct 83.

This complex and expensive face steamer is designed to be used only for a commercial purpose. While the discharged vapor may open the pores in the face skin, the steamer can neither massage nor clean the face.

OBJECT OF THE INVENTION

The object of the present invention is to provide a skin cleaner of a domestic type which massages as well as cleans the face of a user.

SUMMARY OF THE INVENTION

A skin cleaner includes a lower container, and an upper bowl having a rim defining an opening for receiving the face of a user. The container has a chamber for containing a first liquid while the bowl has a cup located in the opening for containing a second liquid. A heater is provided for heating and converting the second liquid into vapor, which is then discharged from the cup into the opening of the bowl. The skin cleaner further includes a nozzle disposed in the bowl, and a pump for pumping the first liquid to the nozzle and spurting the first liquid from the nozzle over the face in the bowl.

Other objects, advantages and novel features of the invention will become more apparent from the following detailed description when taken in conjunction with the accompanying drawings.

DETAILED DESCRIPTION OF THE PREFERRED EMBODIMENT

The figures show a preferred embodiment of a skin cleaner in accordance with the present invention for massaging as well as cleaning the face of a user.

Figure 1:
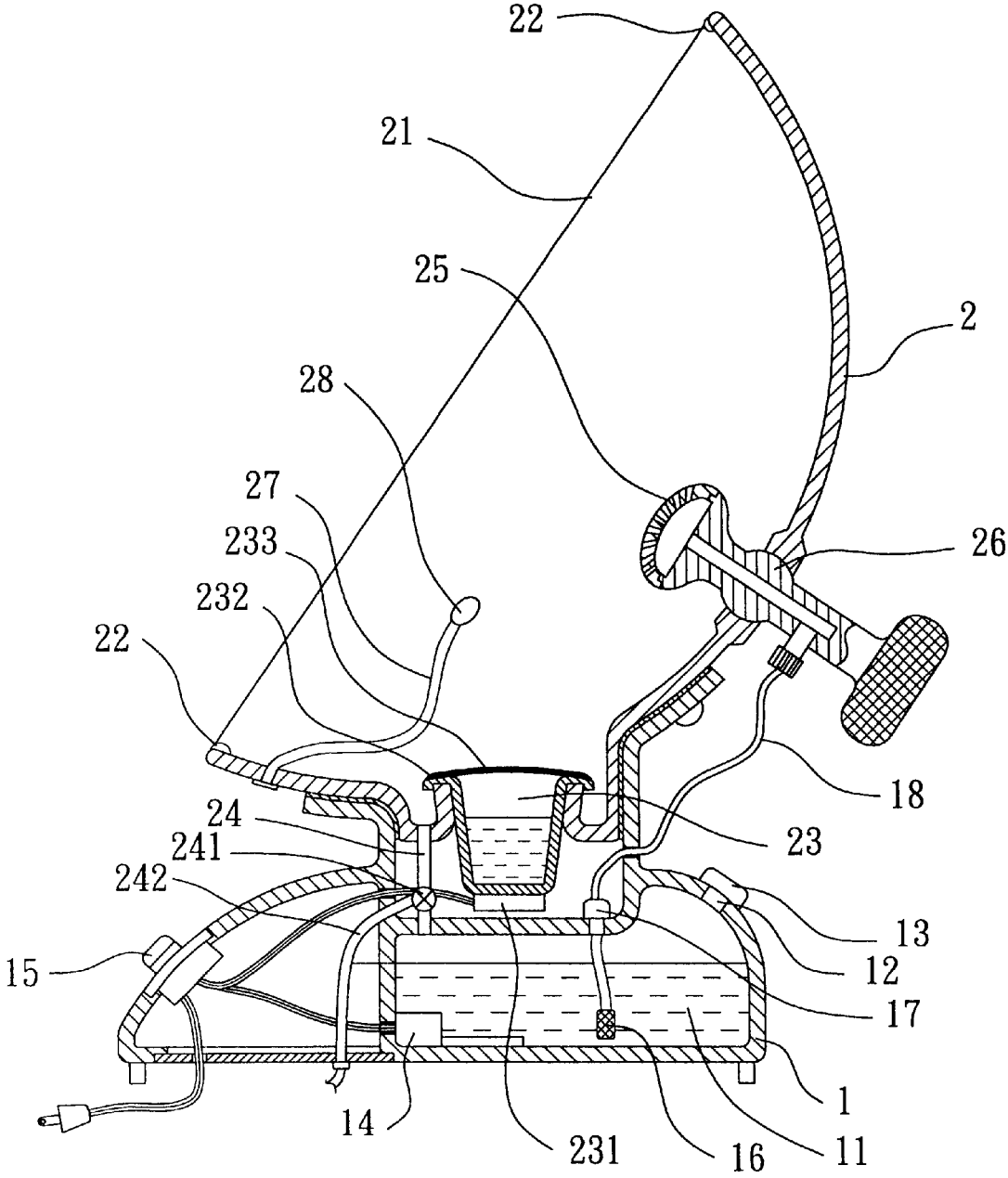
FIG. 1 is a transverse sectional view of a preferred embodiment of a skin cleaner in accordance with the present invention.

Referring to FIG. 1, the inventive cleaner includes a container 1 having a chamber 11 for containing a first liquid, such as water, milk, perfume or the mixture thereof. The first liquid can be introduced into the chamber 11 through an inlet 12, which is normally covered with a lid 13. A first heater 14 is provided for heating up the first liquid to a predetermined temperature under the control of a control unit 15.

Figure 2:
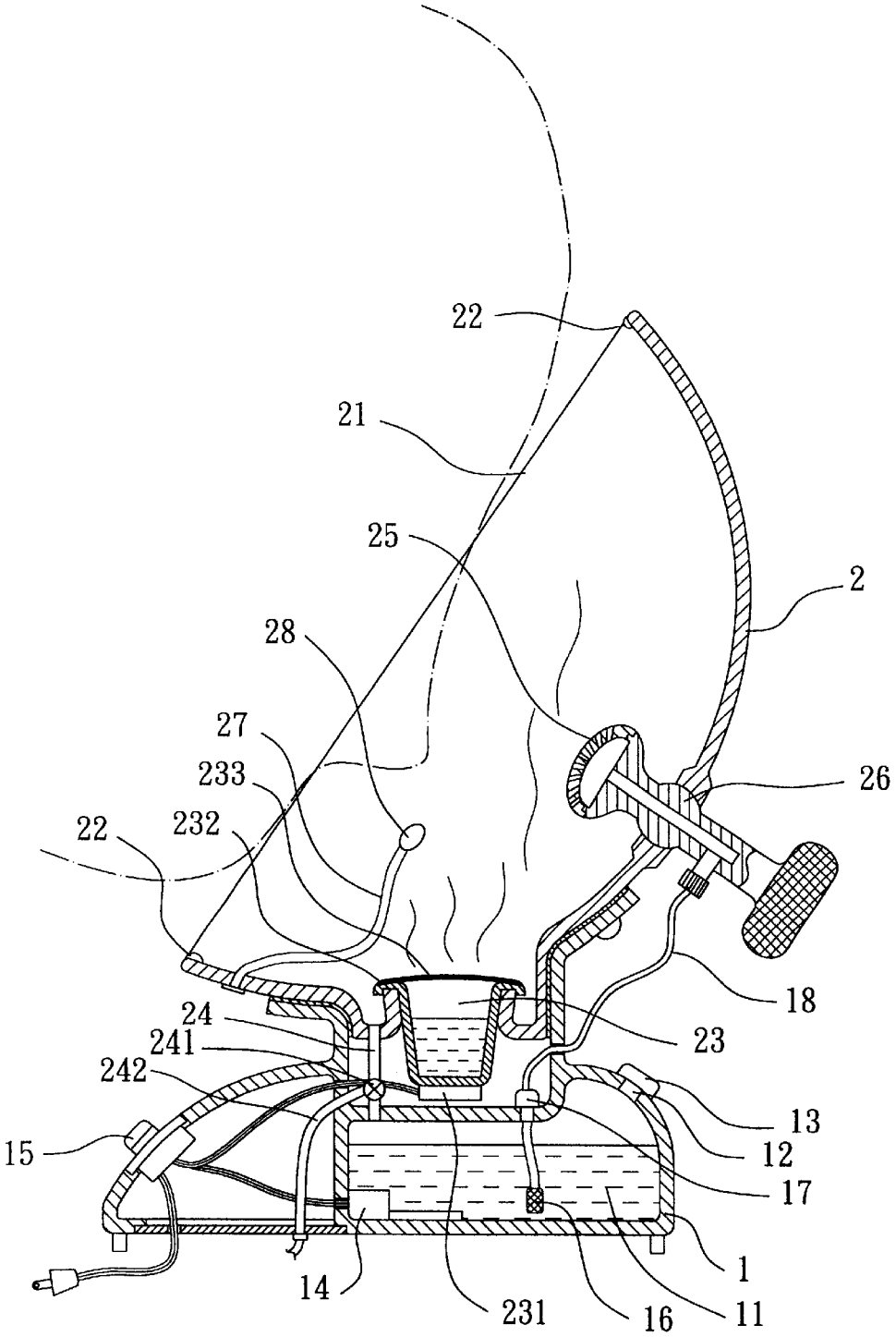
FIG. 2 is a transverse sectional view showing the skin cleaner of FIG. 1 operated in a first mode.
Figure 3:
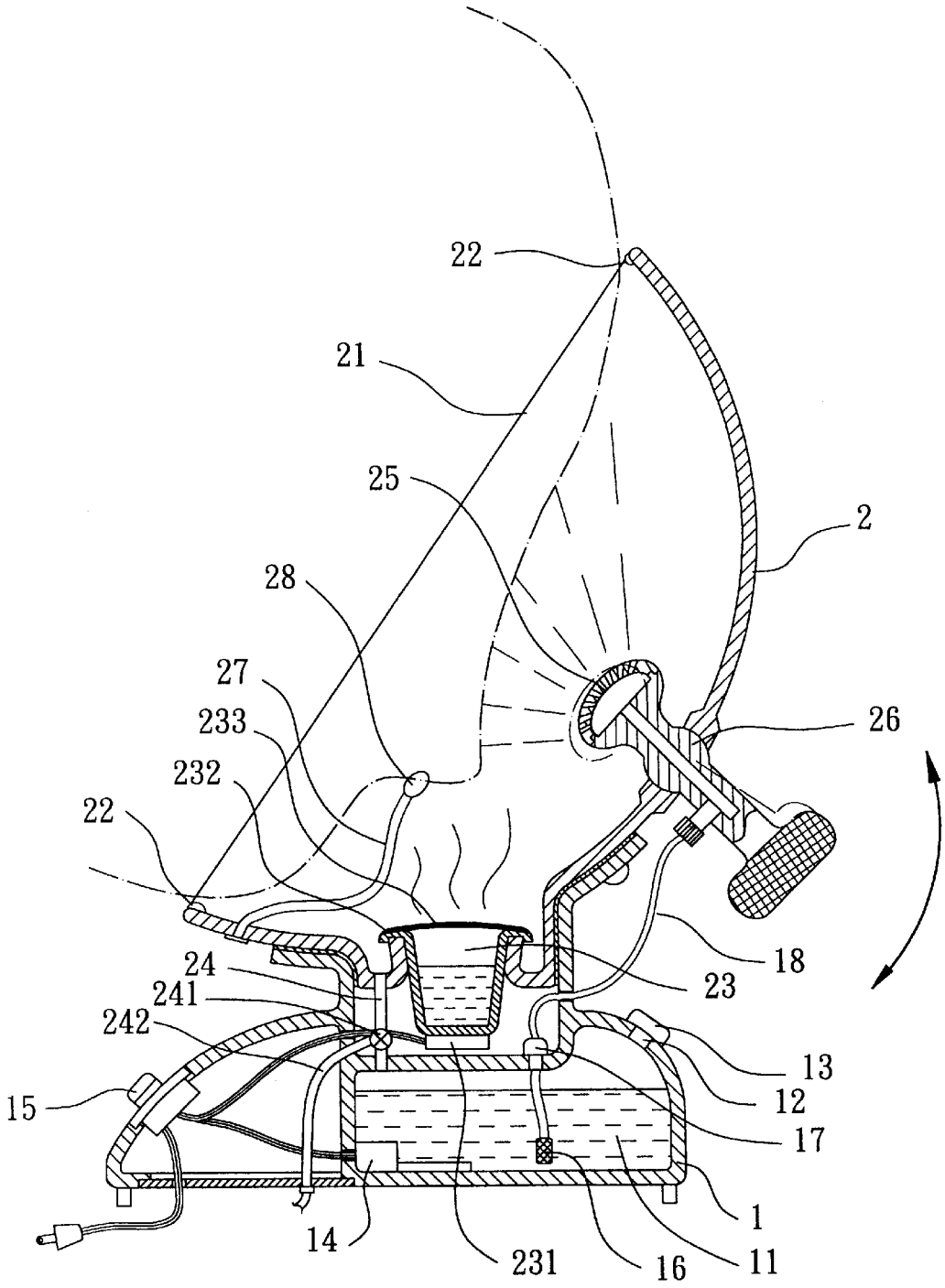
FIG. 3 is a block diagram of the operation of the skin cleaner of FIG. 1.

Atop the container 1 is a bowl 2 that may be formed integrally with the container 1 or, alternatively, may be made separately from the container 1 and then attached thereto. The bowl 2 has a rim 21 defining an opening for receiving the face of users, as shown in FIGS. 2 and 3. Additionally, the bowl 2 is provided at the rim 21 with a pair of detectors 22 that detect the distance from the rim 21 to the face of the user and then send signals, which is to be described hereinafter in detail.

In a lower place within the opening of the bowl 2 there is a cup 23, covered with a cover 232, for containing a second liquid, such as water, milk, perfume or the mixture thereof. The second liquid can be heated up by a second heater 231 also under the control of the control unit 15 and converted into vapor, which is then discharged from the cup 23 into the opening of the bowl 2 through a plurality of orifices 233 defined in the cover 232.

The inventive cleaner further includes a nozzle 25 disposed in the bowl 2 and a pump 17 for pumping the warm first liquid from the chamber 11 of the container 1 to the nozzle 25 via a hose 18, which is provided with a filter 16 to separate the first liquid from any foreign matter suspended therein.

It is preferable that the nozzle 25 is articulated, at its joint 26, with the bowl 2 and is therefore adjustable in its orientation relative to the bowl 2. More preferably, the pump 17 is selected so that the warm liquid may be spurt intermittently from the nozzle 25, thereby cleaning and massaging the face of the users.

Any liquid either spurt from the nozzle 25 or condensed from the vapor would accumulate in the opening of the bowl 2 and even overflow unless it is removed time to time. For this reason, the bowl 2 has a drainpipe 24 to drain out the liquid accumulating in the bowl 2. In the illustrated embodiment, the drainpipe 24 is additionally formed with a valve 241 that allows the drainpipe 24 to be in fluid communication with the chamber 11 of the container 1 or, alternatively, with a recycle pipe 242. Therefore, the liquid in the bowl 2 can be lead either to the chamber 11 or to the exterior of the cleaner through the recycle pipe 242.

Furthermore, an air-pipe 27 is provided for introducing fresh air into the bowl 2. In detail, the air-pipe 27 has a first end outside the bowl 2 and a second end inside the bowl 2, with a removable contact part 28 attached to the second end of the air-pipe 27. The second end of the air-pipe 27 is positioned in such a place that at least one nostril or the mouth of the users may be moved close to the contact part 28, thus enabling the users to breathe properly while his/her face is being treated in the bowl 2.

Referring to FIG. 2, the inventive cleaner can be used by operating the control unit 15 to actuate the second heater 231. Once the liquid in the cup 23 is heated up and vaporized, the user can put his/her face into the bowl 2 for a period of time to force the face to meet the rising vapor. The hot vapor will finally open the pores in the skin, so that greasy debris in the pores can be easily cleared. This is beneficial to the skin of the user's face.

During the process, however, the user should put his/her face into the bowl 2 at a certain distance from the rim 21. If the face is located at a distance closer than a safety distance, the detectors 22 positioned at the rim 21 will send a first signal that makes the second heater 231 inactive, so as to prevent the user from scalding the face by the hot vapor.

Referring to FIG. 3, the control unit 15 may also actuate the first heater 14 and the pump 17. As soon as the actuated heater 14 heats up the liquid contained in the chamber 11 to the predetermined temperature, the pump 17 is actuated and begins to pump the warm liquid from the chamber 11 to the nozzle 25, where the warm liquid is spurt intermittently over the face of the users, cleaning and massaging the face. This is much more beneficial to the skin of the users' face.

Here again, if the face is located at a distance beyond a necessary distance from the rim 21 of the bowl 2, the detectors 22 will send a second signal that makes the pump 17 inactive, so as to preventing spurt liquid from splashing any part of the users other than the face.

Figure 4:
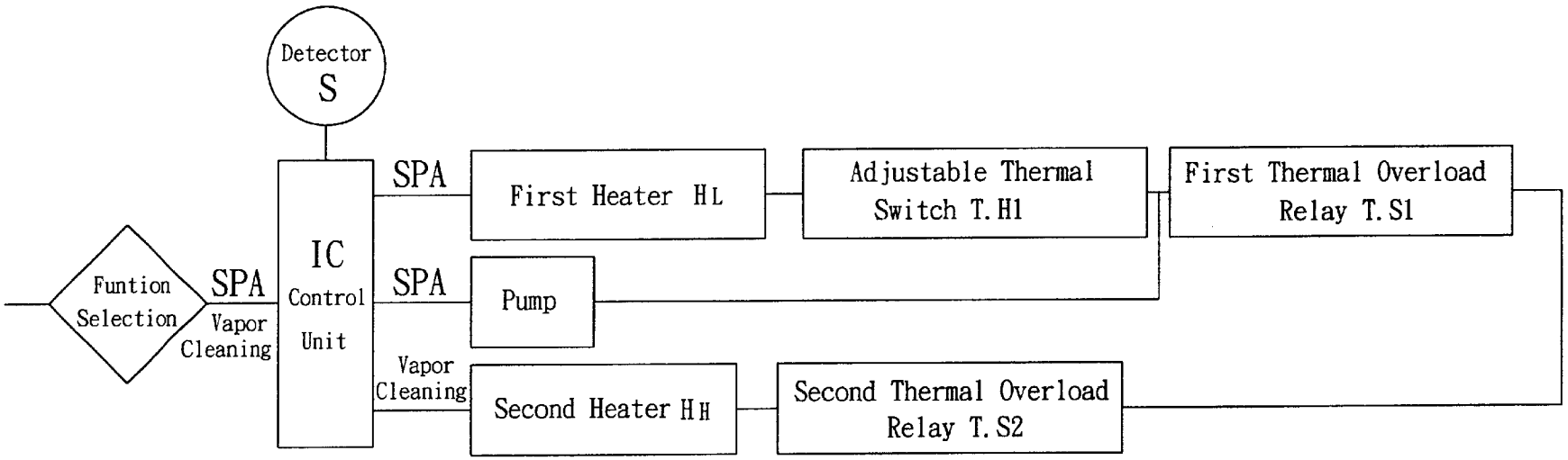
FIG. 4 is a block diagram of the operation of the skin cleaner of FIG. 1.

Referring to FIG. 4, the inventive cleaner can be selectively operated either in a SPA (single cleaning) mode or in a vapor cleaning mode, such as by depressing a particular key in a function selection. An IC (integrated circuit), acting as the above-mentioned control unit, is electrically connected both to the keys in the function selection and to the detectors S, which send signals to the IC if the users' face is located at a improper distance from the rim of the bowl.

In addition, the IC is electrically connected to the first heater $H_L$, an adjustable thermal switch T.H1, a first thermal overload relay T.S1 and the pump for the operation in the SPA (single cleaning) mode. The IC is further electrically connected to the second heater $H_H$ and a second thermal overload relay T.S2 for the operation in the vapor cleaning mode. That is, the IC actuates the first heater $H_L$, the adjustable thermal switch T.H1, the first thermal overload relay T.S1 and the pump if the SPA (single cleaning) mode is selected, but actuates the second heater $H_H$ and the second thermal overload relay T.S2 if the vapor cleaning mode is selected.

Figure 5:
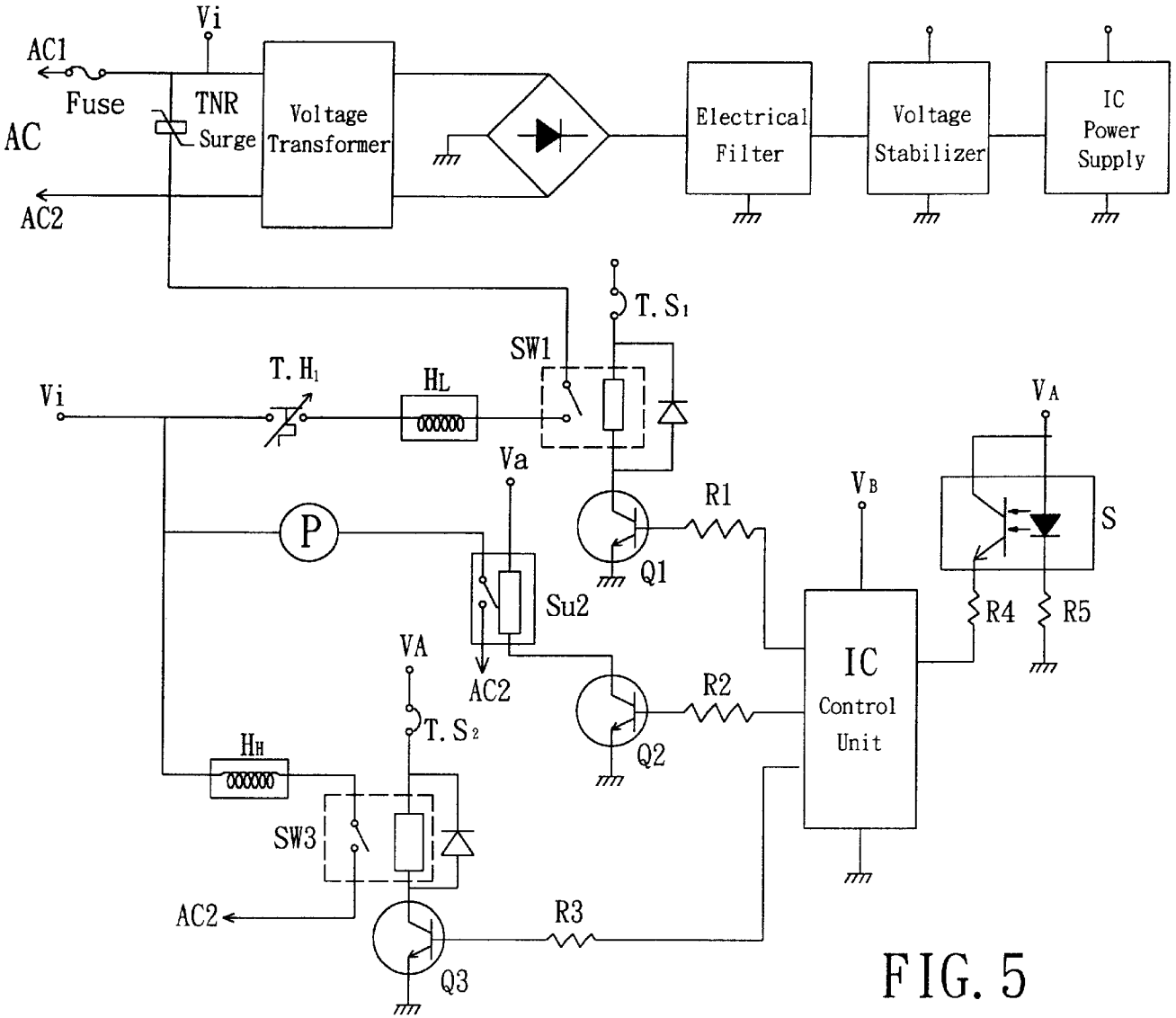
FIG. 5 is a schematic diagram of a circuit involved in the skin cleaner of FIG. 1.
Figure 6:
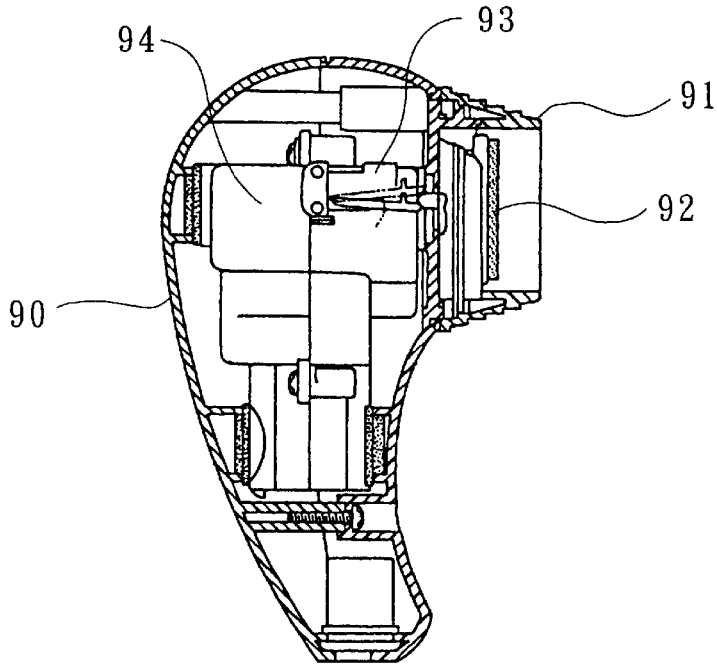
FIG. 6 PRIOR ART
FIG. 6 is a transverse sectional view of a conventional face massager.
Figure 7:
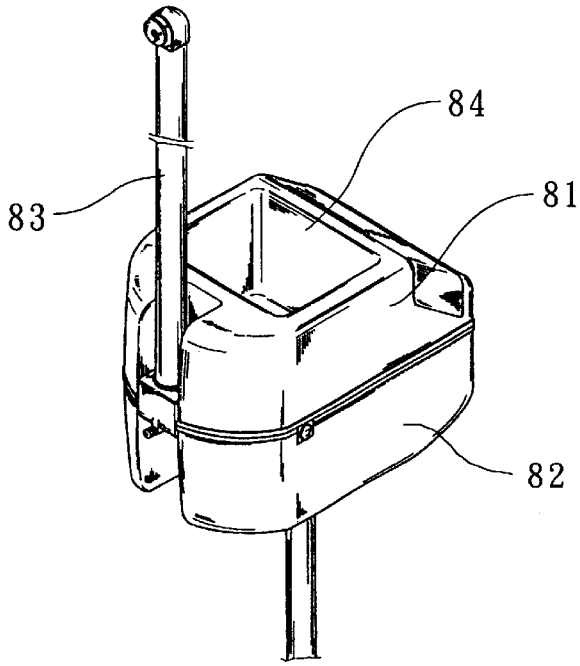
FIG. 7 PRIOR ART
FIG. 7 is a perspective view of a conventional face steamer.

Referring to FIG. 5, there is shown a diagram of a circuit involved in the inventive cleaner. The circuit includes a voltage transformer, a rectifier, an electrical filter, a voltage stabilizer, and a power supply for the IC.

Referring to FIGS. 4 and 5, in the SPA (single cleaning) mode the detectors S will send a first signal to the IC whenever the users' face is located at a too long distance from the rim of the bowl, as illustrated in FIG. 2. The IC then sends out a signal that makes the pump P inactive.

The IC is additionally connected in series with the adjustable thermal switch T.H1 and the first thermal overload relay T.S1, which may stop the electrical current from passing through the first heater $H_L$ either directly or by turning off a switch SW1 in case the heater $H_L$ overheat the liquid contained in the chamber of the container.

Referring still to FIGS. 4 and 5, in the vapor cleaning mode the detectors S will send a second signal to the IC whenever the users' face is at a too short distance from the rim of the bowl and tends to be scaled, as illustrated in FIG. 3. The IC then sends out a signal that makes the second heater $H_H$ inactive. As a result, the operation of the inventive cleaner is automatically shifted into the SPA (single cleaning) mode.

The IC is additionally connected in series with the second thermal overload relay T.S2, which may stop the electrical current from passing through the second heater $H_H$ by turning off another switch SW3 in case the heater $H_H$ overheat the liquid contained in the cup.

Referring to FIG. 5, the IC is still in operation even when the electrical current passing through the first heater $H_L$ or the second heater $H_H$ is stopped by the switch SW1 or switch SW3.

From the foregoing, it is apparent that this invention has the advantage of opening the pores in the skin and enabling greasy debris therein to be easily cleared. Furthermore, the warm liquid spurt intermittently from the nozzle can massage as well as clean the face of the users, bringing a more beneficial effect to the skin.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A skin cleaner, comprising:

a container having a chamber configured for containing a first liquid;

a bowl having a rim defining an opening for receiving a user's face, said bowl being formed with a cup located in said opening for containing a second liquid;

a heater for heating and converting said second liquid into vapor, said vapor being discharged from said cup into said opening of said bowl;

a nozzle disposed in said bowl;

a pump configured for pumping said first liquid to said nozzle and spurting said first liquid from said nozzle over a user's face received in said bowl; and said bowl having a drainpipe adapted to drain out any liquid accumulating in said opening of said bowl, said bowl is provided with an air-pipe having a first end outside said bowl and a second end inside said bowl, and wherein said second end of said air-pipe is positioned such that at least one nostril of a user may be moved close to said second end thereof.

2. The skin cleaner as claimed in claim 1, wherein said container defines an inlet for entrance of said first liquid into said chamber.

3. The skin cleaner as claimed in claim 1, further including an additional heater configured for heating said first liquid to a predetermined temperature.

4. The skin cleaner as claimed in claim 1, wherein said pump has a hose provided with a filter.

5. The skin cleaner as claimed in claim 1, wherein said cup is covered with a cover, and wherein said cover has a plurality of orifices configured for discharging said vapor from said cup into said opening of said bowl.

6. The skin cleaner as claimed in claim 1, wherein said drainpipe is in fluid communication with said chamber of said container.

7. The skin cleaner as claimed in claim 6, wherein said drainpipe has a valve configured to allow said drainpipe to be in fluid communication with a recycle pipe.

8. The skin cleaner as claimed in claim 1, wherein said bowl is provided with at least one detector at said rim, and wherein said at least one detector sends a first signal that makes said heater inactive if a user's face is located at a distance closer than a safety distance from said rim of said bowl, and a second signal that makes said pump inactive if a user's face is located at a distance beyond a necessary distance from said rim of said bowl.

9. A skin cleaner comprising a container, a bowl, a cup, and a nozzle disposed in said bowl, said container and said cup being provided for containing respective liquids, said liquid in said cup being heated and converted into vapor to be discharged into said bowl, and said liquid in said container being pumped and spurted from said nozzle in said bowl;

said bowl is provided with an air-pipe having a first end outside said bowl and a second end inside said bowl, and wherein said second end of said air-pipe is positioned in such a place that at least one nostril of a user may be moved close to said second end; and said air-pipe is formed with a removable contact part at said second end.

10. The skin cleaner as claimed in claim 12, wherein said nozzle is articulated with said bowl and is therefore adjustable in its orientation relative to said bowl.

11. The skin cleaner as claimed in claim 9, wherein said bowl is formed integrally with said container.

12. The skin cleaner as claimed in claim 9, wherein said bowl is made separately from said container and then attached to said container.

13. A skin cleaner, comprising:

a container having a chamber configured for containing a liquid;

a bowl having a rim defining an opening for receiving a user's face, said bowl being formed with a drainpipe adapted to drain out any liquid accumulating at the bottom of said opening of said bowl;

said bowl is provided with an air-pipe having a first end outside said bowl and a second end inside said bowl, and wherein said second end of said air-pipe is positioned such that at least one nostril of a user may be moved close to said second end thereof;

a nozzle disposed in said bowl; and a pump configured for pumping said liquid to said nozzle and spurting said liquid from said nozzle over a user's face received in said bowl.

14. The skin cleaner as claimed in claim 13, wherein said nozzle is articulated with said bowl and is therefore adjustable in its orientation relative to said bowl.

15. The skin cleaner as claimed in claim 13, wherein said air-pipe is formed with a removable contact part at said second end.

16. The skin cleaner as claimed in claim 13, wherein said drainpipe may be in fluid communication with said chamber of said container.

17. The skin cleaner as claimed in claim 13, wherein said drainpipe has a valve to allow said drainpipe to be in fluid communication with a recycle pipe.

18. The skin cleaner as claimed in claim 13, wherein said bowl is provided with at least one detector formed thereon, and wherein said at least one detector sends a signal that makes said pump inactive if a user's face is located at a distance beyond a necessary distance from said rim of said bowl.

* * * * *